United States Patent [19]

Rusbach

[11] 4,016,800

[45] Apr. 12, 1977

[54] PORTABLE FIREARM WITH A RETRACTABLE BARREL

[75] Inventor: Maurice Rusbach, Vernier Geneva, Switzerland

[73] Assignee: Sarmac S.A., Geneva, Switzerland

[22] Filed: Nov. 29, 1974

[21] Appl. No.: 528,392

[30] Foreign Application Priority Data

Dec. 28, 1973 Switzerland ..... 18209/73

[52] U.S. Cl. ..... 89/177; 42/75 B; 188/321; 403/109; 403/322

[51] Int. Cl.[2] ..... F41C 7/10; F41C 21/18

[58] Field of Search ..... 89/40 K, 43 R, 160, 89/162, 170, 177, 178, 37 H; 188/321; 403/109, 322, 325, 330; 42/72, 73, 75 B

[56] References Cited

UNITED STATES PATENTS

| | | | |
|---|---|---|---|
| 1,447,087 | 2/1923 | Joyce | 89/43 R |
| 1,480,557 | 1/1924 | Joyce | 89/177 |
| 1,563,737 | 12/1925 | Froelich | 89/37 H |
| 2,067,322 | 1/1937 | Herlach et al. | 89/177 |
| 2,437,548 | 3/1948 | Patchett | 42/72 |
| 2,688,173 | 9/1954 | Van Peet | 403/322 |
| 3,469,872 | 9/1969 | Damm et al. | 403/325 |
| 3,636,813 | 1/1972 | Wiemers | 89/43 R |

*Primary Examiner*—Stephen C. Bentley
*Attorney, Agent, or Firm*—Young & Thompson

[57] ABSTRACT

A portable fire-arm having a recoil brake braking the recoil stroke of the barrel relative to the breech-carrier when a shot is fired, which includes a manually operated mechanical connection device between the barrel and the recoil brake the whole being so arranged that the barrel can be manually retracted into the breech-carrier in the retracted carrying position, the brake being rendered inoperative. A device is provided for locking the barrel relative to the breech-carrier in that retracted position.

9 Claims, 14 Drawing Figures

PORTABLE FIREARM WITH A RETRACTABLE BARREL

The power of certain shoulderable infantry weapons can require the use of a recoil brake having a considerable stroke. In fact the absorption of the recoil energy must be sufficient to make the effect of the recoil thrust bearable on the shoulder of the firer or, possibly, on a lightweight aiming support.

As these light weapons are portable, it is of the greatest advantage for them to be as small as possible, particularly lengthwise, to facilitate carrying. Similarly, these weapons must be strong and rigid, because of the conditions under which they may be used.

This shortening to facilitate carrying may be obtained using the length of the recoil stroke, in view of its magnitude. The weapon can therefore be shortened by the amount of the stroke of the recoiling mass.

The present invention relates to a fire-arm with a retractable barrel whose essential feature resides in the possibility of inserting and fixing the recoiling mass inside the stock (breech-carrier) after disconnection of its recoil brake.

The invention includes a manual means for movement of the recoiling mass by disconnection of its recoil brake without affecting the operation of the latter and a means for locking in the retracted position to facilitate carrying.

In accordance with the invention, disconnection takes place at the connecting element between the barrel, which is a component of the recoiling mass, and the recoil-brake, which is generally of the oleopneumatic type, fixed on and above the stock.

So as to be independent of the brake and prevent its operation, in order not to have to produce an exaggerated effort when the recoiling mass assembly is retracted into the weapon in the course of the shortening operation, the barrel is disconnected from the brake by a manually operated mechanical connection device. Only the breech recuperation spring is compressed.

The weapon in accordance with the invention can operate on the following principle.

The weapon may be of the semi-automatic type and have a brake mounted in its upper portion.

In the closed position, the breech is made fast with the barrel by locking onto the latter. After a shot has been fired, they perform the entire recoil stroke together. A large part of the recoil energy of this barrel-breech assembly is absorbed by an oleo-pneumatic recuperator brake connected to the barrel.

At the end of the recoil stroke, the breech is unlocked from the barrel and remains held in the rear position while the gas of the recuperator brake, acting as a spring as it expands, returns the barrel alone forwards to its starting position.

Before reaching this starting position, the barrel causes the ejection of the case and then the release of the breech; the latter returns forwards under the thrust of its spring; on the way, it strips a round from the loading-clip and engages it in the chamber of the barrel. With its stroke completed, the breech locks back onto the barrel in the closed position.

When a shot has just been fired, the barrel-breech assembly moves backwards in the following manner:

1. The first portion of the stroke, over a length of 20 mm, takes place without oleo-pneumatic braking; only the breech-spring is operative. The purpose of this precaution is to allow the projectile time to leave the barrel before a reaction is produced on the weapon.
2. Then action on brake and breech-spring until end of stroke.
3. Recocking of the striking hammer.
4. Just before stoppage of the assembly, unlocking of the breech from the barrel.
5. Stoppage of the barrel and the breech.
6. Locking of the breech in the rear position.

The next phase of operation, the forward motion of the barrel, takes place in the following manner:

1. Forward return of the barrel alone, under the influence of the recuperator, in which the gas is expanding.
2. Extraction of the case by the extractor on the breech.
3. Ejection of the case.
4. With the clip uncovered by the lower portion of the barrel, ascent of a round into the feed position.
5. Release of the breech.
6. Stoppage and centering of the barrel in the starting position.

The last phase of operation is the forward motion of the breech which takes place as follows:

1. Forward return of the breech under the influence of the breech-spring.
2. Extraction of a round from the clip.
3. Introduction of the round into the chamber of the barrel.
4. Locking of the breech onto the barrel in the closed position.

To initiate another cycle, another shot must be fired by applying pressure to the trigger after this has firstly been completely released. It should be noted that the ejection port has been provided to satisfy 3 eventualities, which are:

1. Ejection of a spent explosive cartridge case: maximum recoil stroke.
2. Ejection of a spent piercing round case: minimum recoil stroke because of the lesser mass of this round.
3. Ejection of a complete round by manual extraction.

The weapon also has a manual cocking lever which only drives the breech. Its first action at the start of its stroke is to unlock the breech from the barrel. Manual action of the cocking lever is necessary in the following case:

1. To reload the empty weapon in the rest position. Breech closed.
2. To extract a complete round. Change of ammunition or unloading of the weapon.
3. To correct a firing malfunction such as: faulty extraction of a spent case, faulty feeding . . . etc..

For the case of an oil leak or breakage of the connection between the oleo-pneumatic brake and the barrel-breech assembly, which would thus be hurled backwards without any longer being damped, a total absorption brake may optionally be arranged between breech and breech-carrier, to function after the normal stroke has been exceeded.

The attached drawings show diagrammatically and by way of example the weapon described and more particularly the connection device or mechanical connector which is the object of the present invention.

Figure 3:
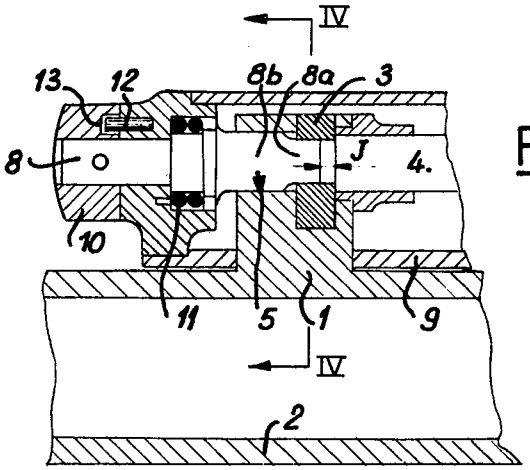
FIG. 3 is a longitudinal section of the mechanical connector.

The mechanical connection device comprises a connector 1 which is rigidly mounted on or forms an integral part of the barrel 2 of the weapon. This connector 1 is drilled through to receive a stop 3 pivoting on an axle 7. The connector 1 also has an axial bore 5 whose diameter corresponds to the outside diameter of a rod 4 fast with the piston of the oleo-pneumatic brake. In the position shown in FIGS. 3 and 5, by blocking the bore 5 the stop 3 prevents passage of the rod 4 of the recoil brake through the connector 1. In this manner, after firing of the shot, the connector being driven backwards by the barrel with which it is fast, the stop 3 enters into contact with the front end of the rod 4 of the brake and drives the latter rod through the travel of the connector 1. This backward motion of the rod 4 causes the action of the recoil brake.

Figure 6:
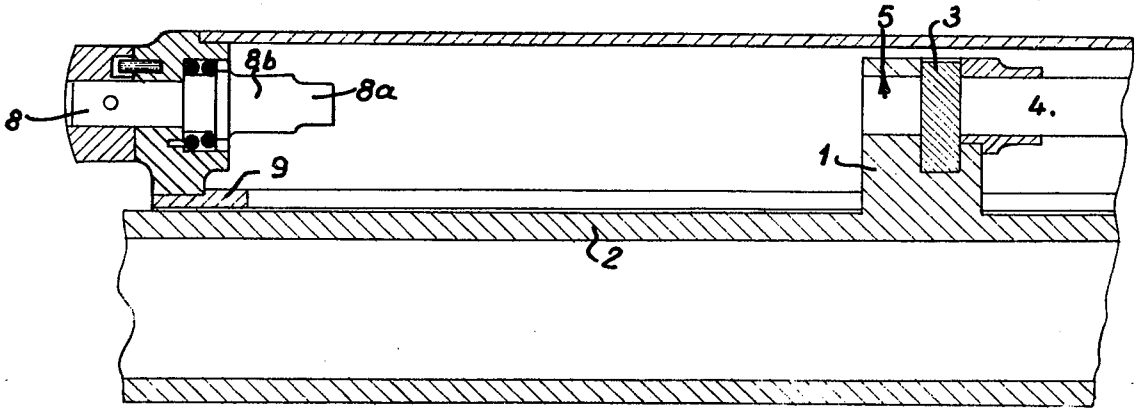
FIG. 6 is a partial longitudinal section of the weapon, the barrel being connected to the oleo-pneumatic brake and in the course of the recoil stroke.

Conversely, at the forward return stroke of the rod 4 under the influence of the compressed gases of the oleo-pneumatic brake (FIG. 6) the rod 4 drives the connector 1 and therefore the barrel 2 in its forward stroke until it reaches its initial service position.

Figure 4:
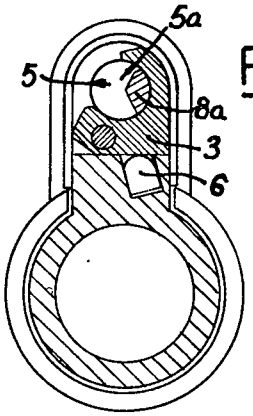
FIG. 4 is a section along the line IV—IV of FIG. 3 with the connector in the disconnected position.
Figure 7:
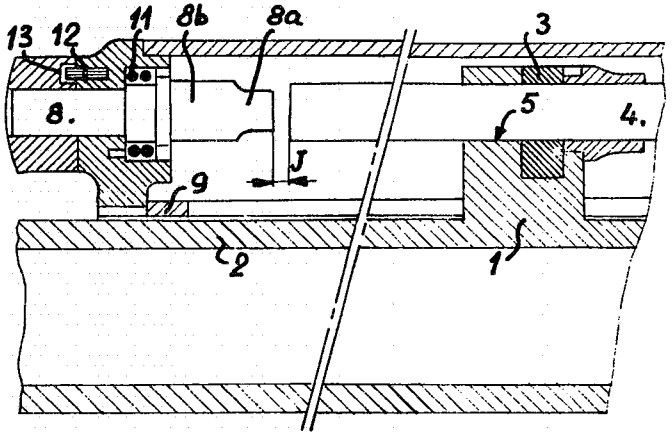
FIG. 7 is a partial longitudinal section of the weapon, the barrel being disconnected from the oleo-pneumatic brake and in the intermediate position.
Figure 8:
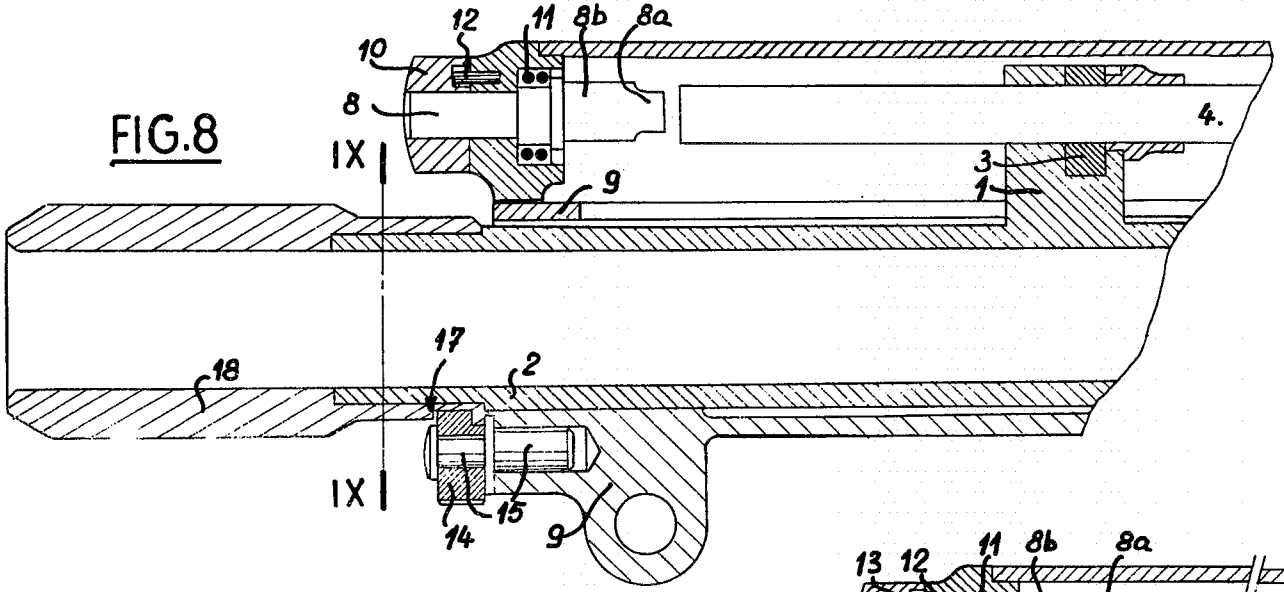
FIG. 8 is a section similar to that of FIG. 7, the barrel being in the retracted carrying position.

FIGS. 4, 7 and 8 show the connection device in the disconnected position. In this position the stop 3 is moved against the influence of the sprung button 6 and the bore 5 is open so that the rod 4 can pass and slide through the connector 1.

Figure 1:
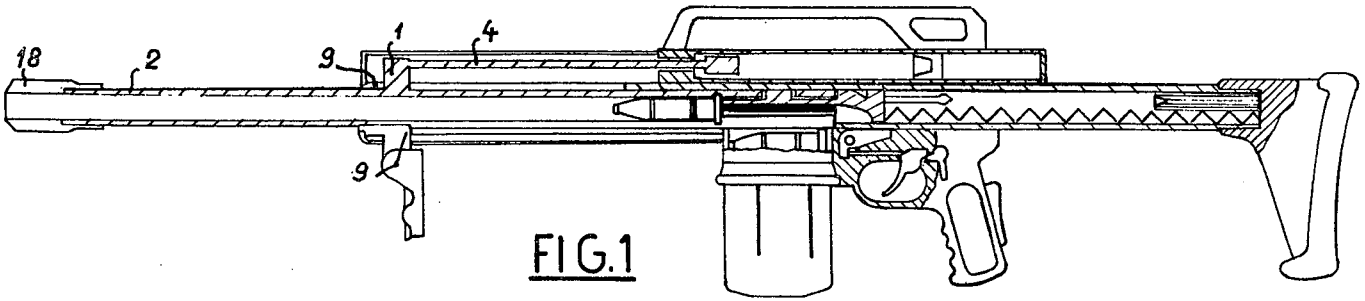
FIG. 1 is a section of the weapon in the firing position.
Figure 2:
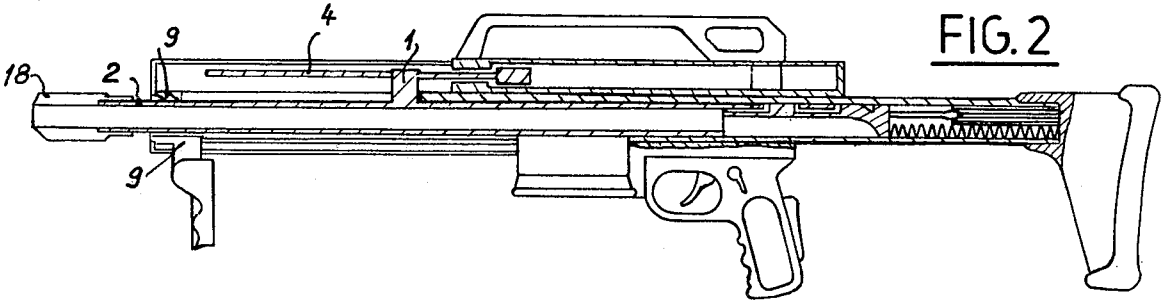
FIG. 2 is a section of the weapon in the carrying position.
Figure 5:
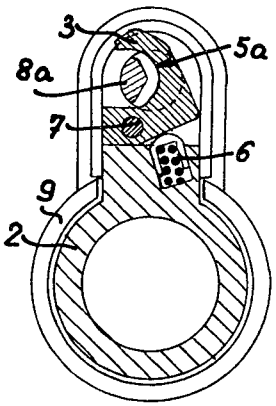
FIG. 5 is a section along the line IV—IV of FIG. 3 with the connector in the connected position.

The natural position of the stop 3 is the closed position, shown in FIG. 5, in which the connection device is active.

In the open, disconnected position shown in FIG. 4, the stop 3 is moved angularly about its axis 7 against the action of the sprung button 6. The stop 3 is so moved and temporarily held in this open position by means of an opening key 8.

The assembly of the key 8 (support and control) belongs to the breech-carrier 9 (fixed part of the weapon) and is therefore in a fixed position relative to the barrel 2 which is rectilinearly mobile relative to it.

In the service position, with the barrel extended, the portion 8*b* of the key 8 is engaged in the bore 5 of the connector 1 and the bit 8*a* of the key, formed by a sector of the cylinder 8*b*, enters the vacant portion of this bore 5 which is not blocked by the mobile stop 3 in the closed position of FIG. 5.

FIG. 5 shows the bit in the natural connection position. In this position the key does not act on the mobile stop. This key is held in this inactive position by a spring 11. After firing of a shot, the bore 5 leaves the key (FIG. 6) to come back over it on return (FIG. 3), the stop 3 still remaining closed. The disconnection operation can only be effected manually be turning the button 10 fast with the key 8 against the action of its return spring 11. This operation causes the rotation of the bit 8*a* toward the position of FIG. 4 which, after rotating through approximately 90°, makes the stop 3 open by pivoting about its axle 7, placing its position of bore 5*a* of the same diameter as bore 5 in alignment with the latter. At this moment the stop 3 is in the open position. As the penetrating portion of the bit 8 occupies part of the thickness of the stop 3, leaving a gap 3 between its end and that of the rod 4, the latter can take over from the bit as soon as pressure is applied to the end of the barrel 2 to push it in. As soon as this take-over has been accomplished after a movement of a few millimeters, the button 10 can be released. As a result, the key is turned by the previously tensioned spring 11 which returns it backwards to its initial neutral position of FIG. 5.

This position allows the stop 3 to return to the closed (connection) position.

The weapon described also has a device for locking the barrel 2 in the retracted carrying position.

Figure 9:
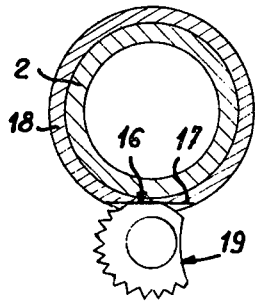
FIGS. 9 and 10 are sections along the line IX—IX of FIG. 8 showing a mechanical first embodiment of a lock in the active and inactive positions respectively.
Figure 10:
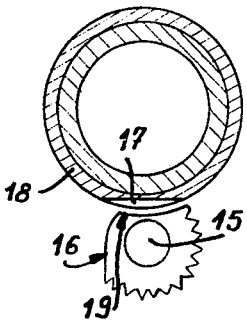

A first modification, shown in FIGS. 8, 9 and 10, includes a lock comprising a serrated wheel 14 mounted rotatably on an axle 15 fast with the breech-carrier 9. Locking is effected as shown in FIGS. 8 and 9 when, with the barrel 2 fully retracted, a portion 16 of the serrated wheel enters a notch 17 in the flash arrester 18 or the front end of the barrel. To cause locking, the serrated wheel is rotated manually, by pressure of the thumb for example. Unlocking is effected in the same manner in the opposite direction. For the unlocked position the serrated wheel 14 has a circular clearance 19 of a radius slightly greater than the external radius of the flash arrester or of the barrel 2 so as to ensure free passage of the latter.

Figure 11:
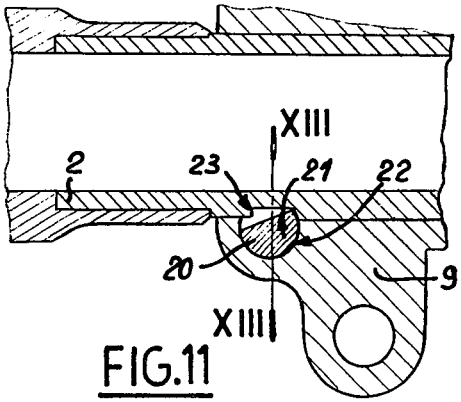
FIG. 11 shows a section of a detail of the weapon barrel, showing a second embodiment of a mechanical lock in the active position.
Figure 12:
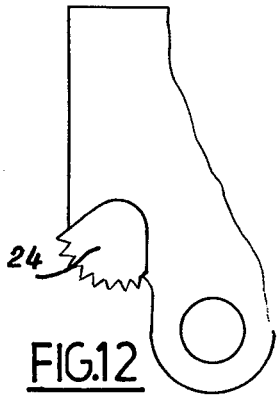
FIG. 12 shows the barrel detail shown in FIG. 11, but viewed externally.
Figure 13:
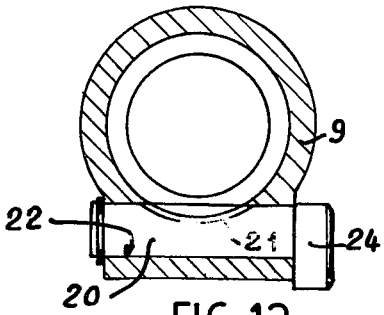
FIG. 13 is a section along the line XIII—XIII of FIG. 11.
Figure 14:
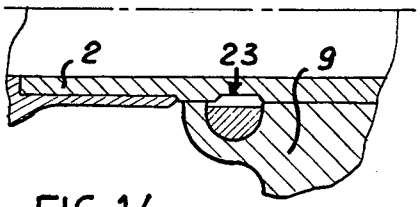
FIG. 14 is a view identical to FIG. 11, with the locking member in the inactive position.

In the second modification shown in FIGS. 11 to 14, the lock comprises an axle 20 having a portion machined out in a half-moon 21 of a radius slightly greater than the external radius of the barrel 2 (or with a portion machined flat). This axle 20 is housed in a bore 22 in the end of the breech-carrier 9 and so situated relative to the barrel that a small rotation enables the axle 20 to insert a portion of its solid part as shown in FIG. 11 in a notch 23 in the barrel, locking the latter in the retracted position. In the unlocked position, the machined portion 21 permits free passage of the barrel. Rotation of the axle is caused by manual action on the serrated lever 24 fast with the axle 20 as seen in FIGS. 12 and 13. FIG. 14 shows the lock in the inactive position.

It is obvious that the connecting apparatus described can itself be used other than in a weapon; in fact this apparatus is advantageous whenever it is necessary to link two mechanical members which have to tansmit a force in one direction.

I claim:

1. A firearm having a stock, a barrel carried by the stock for movement lengthwise of the barrel relative to the stock between an extended firing position and a retracted carrying position, a recoil brake carried by the stock for braking the recoil stroke of the barrel relative to the stock when a shot is fired, a manually operable mechanical connection device between the barrel and the recoil brake for selectively connecting the barrel to the recoil brake in said extended position of the barrel, a manually operated mechanical connection device between the barrel and the stock for selectively connecting the barrel to the stock to retain the barrel in said retracted position of the barrel relative to the stock, the first-mentioned connection device comprising a movable stop carried by and movable relative to said barrel, said recoil brake having a rod that extends parallel to said barrel, and means for selectively moving said stop into and out of the path of said rod with said rod and barrel remaining parallel to each other as said rod and barrel move relative to each other upon movement of said barrel toward said retracted position.

2. A firearm having a stock, a barrel carried by the stock for movement lengthwise of the barrel relative to the stock between an extended firing position and a retracted carrying position, a recoil brake carried by the stock for braking the recoil stroke of the barrel relative to the stock when a shot is fired, a manually operable mechanical connection device between the barrel and the recoil brake for selectively connecting the barrel to the recoil brake in said extended position of the barrel, and a manually operated mechanical connection device between the barrel and the stock for selectively connecting the barrel to the stock to retain the barrel in said retracted position of the barrel relative to the stock, said barrel having a connector projecting laterally therefrom, said connector having a bore therein that extends parallel to said barrel and to said rod, said rod being movable through said bore, said stop being selectively movable into said bore to prevent movement of said rod through said bore.

3. A firearm as claimed in claim 2, and means mounting said stop for pivotal movement on said connector about an axis parallel to said bore, between a position in which said stop is clear of said bore and a position in which said stop is disposed in said bore.

4. A firearm as claimed in claim 3, and a key mounted on said stock and rotatable coaxially of said bore into engagement with said stop for selectively moving said stop between said positions upon rotation of said key.

5. A firearm as claimed in claim 3, and spring means urging said stop into said bore.

6. A firearm having a stock, a barrel carried by the stock for movement lengthwise of the barrel relative to the stock between an extended firing position and a retracted carrying position, a recoil brake carried by the stock for braking the recoil stroke of the barrel relative to the stock when a shot is fired, a manually operable mechanical connection device between the barrel and the recoil brake for selectively connecting the barrel to the recoil brake in said extended position of the barrel, and a manually operated mechanical connection device between the barrel and the stock for selectively connecting the barrel to the stock to retain the barrel in said retracted position of the barrel relative to the stock, the last-mentioned connecting device comprising a lock carried by said stock and selectively engageable in a recess in said barrel.

7. A firearm as claimed in claim 6, said lock being mounted on the forward end of said stock and said recess being disposed adjacent the forward end of said barrel.

8. A firearm as claimed in claim 6, said lock being mounted on said stock for rotation about an axis parallel to the barrel between positions in which said barrel is locked and unlocked relative to said stock.

9. A firearm having a stock, a barrel carried by the stock for movement lengthwise of the barrel relative to the stock between an extended firing position and a retracted carrying position, a recoil brake carried by the stock for braking the recoil stroke of the barrel relative to the stock when a shot is fired, a manually operable mechanical connection device between the barrel and the recoil brake for selectively connecting the barrel to the recoil brake in said extended position of the barrel, and a manually operated mechanical connection device between the barrel and the stock for selectively connecting the barrel to the stock to retain the barrel in said retracted position of the barrel relative to the stock, said brake having a rod thereon that is parallel to said barrel and that moves with each barrel from a forward position to a rear position under the recoil of said barrel, said rod remaining parallel to said barrel and in said forward position when the first-mentioned connection device is disconnected and the barrel is in said retracted position.

* * * * *